United States Patent [19]

Segrest

[11] 4,401,038

[45] Aug. 30, 1983

[54] PROGRESSIVE MOVEABLE HEARTH CREMATOR

[76] Inventor: William W. Segrest, P.O. Box 7796, Orlando, Fla. 32854

[21] Appl. No.: 327,027

[22] Filed: Dec. 3, 1981

[51] Int. Cl.[3] ..... F23G 1/00

[52] U.S. Cl. ..... 110/194; 432/243; 110/210

[58] Field of Search ..... 110/194, 210; 432/243, 432/123

[56] References Cited

U.S. PATENT DOCUMENTS

| | | | |
|---|---|---|---|
| 1,742,868 | 1/1930 | Mann | 110/194 |
| 3,633,885 | 1/1972 | Beck | 432/243 |
| 3,713,631 | 1/1973 | Euk et al. | 432/243 |
| 4,257,335 | 3/1981 | Albertsson | 110/194 |
| 4,321,878 | 3/1982 | Segrest | 110/194 |

*Primary Examiner*—Henry C. Yuen

*Attorney, Agent, or Firm*—Duckworth, Allen, Dyer & Pettis

[57] ABSTRACT

A cremator having a pivotable hearth and a secondary moveable hearth displaceable along a primary chamber and a secondary chamber is disclosed. The pivotable hearth is rotated by means of an exterior hydraulic cylinder coupled to a pivotable hearth. The primary and secondary chamber are separated by an interior wall having a lower portion in close contact with the secondary moveable hearth. Means are provided for moving the secondary hearth from an initial position to sequentially a downward position, a sideways position, an upward position and a final sideways position corresponding to the initial position.

11 Claims, 6 Drawing Figures

13
17
27
33
37
38
45
47
59
87
89
91
93
95
97
99

PROGRESSIVE MOVEABLE HEARTH CREMATOR

BACKGROUND OF THE INVENTION

This invention relates in general to a cremator and more particularly to a cremator provided with a pivotable hearth and a secondary displaceable hearth where continuous cremation can occur without having to reposition partially cremated remains within the cremator.

The art of cremation is, of course, quite old and numerous references have described improvements in cremators. Such patents includes U.S. Pat. No. 1,212,307 (Adams, 1917); U.S. Pat. No. 1,421,919 (Davidson, 1922); U.S. Pat. No. 3,136,273 (Blesch 1964); U.S. Pat. No. 3,176,634 (Martin, 1965); and applicant's own co-pending U.S. Pat. No. 4,321,878. One of the many disadvantages of the prior art system was that the heat generated by the consumption of the body being cremated was wasted. This disadvantage was overcome by applicant's Secondary Hearth Crematory which was the subject of U.S. Pat. No. 4,321,878. The cremator described in that application, however, had the disadvantage that it required manual manipulation of the partially cremated remains so that they could be repositioned to a secondary chamber whereby the heat of cremation of a second body would aid in the final cremation of a first body. This repositioning increases the time that the loading door remains open and thereby increases the escape of heat in the process.

SUMMARY OF THE INVENTION

The improved chamber of this type according to the present invention is characterized by the fact that a pivotable hearth is disposed in a primary chamber separated from a secondary chamber by an interior wall. A moveable hearth spanning the primary and secondary chamber is disposed below a pivotable hearth and a wall. The bottom surface of the wall is in close contact with the moveable hearth, which can move sequentially downwards, sideways, upwards and back sideways to its initial position. The movement of the moveable hearth serves to displace partially cremated remains from the primary chamber to the secondary chamber without manual intervention. A cooling chamber with access from the exterior is provided to cool totally cremated remains and to remove them for final disposition.

Further features of the invention include liquid cooling of the interior wall surface and all high wear points within the cremator.

BRIEF DESCRIPTION OF THE DRAWINGS

Further details are explained below with the help of the examples illustrated in the attached drawings in which.

DETAILED DESCRIPTION OF THE PREFERRED EMBODIMENT

Figure 1:
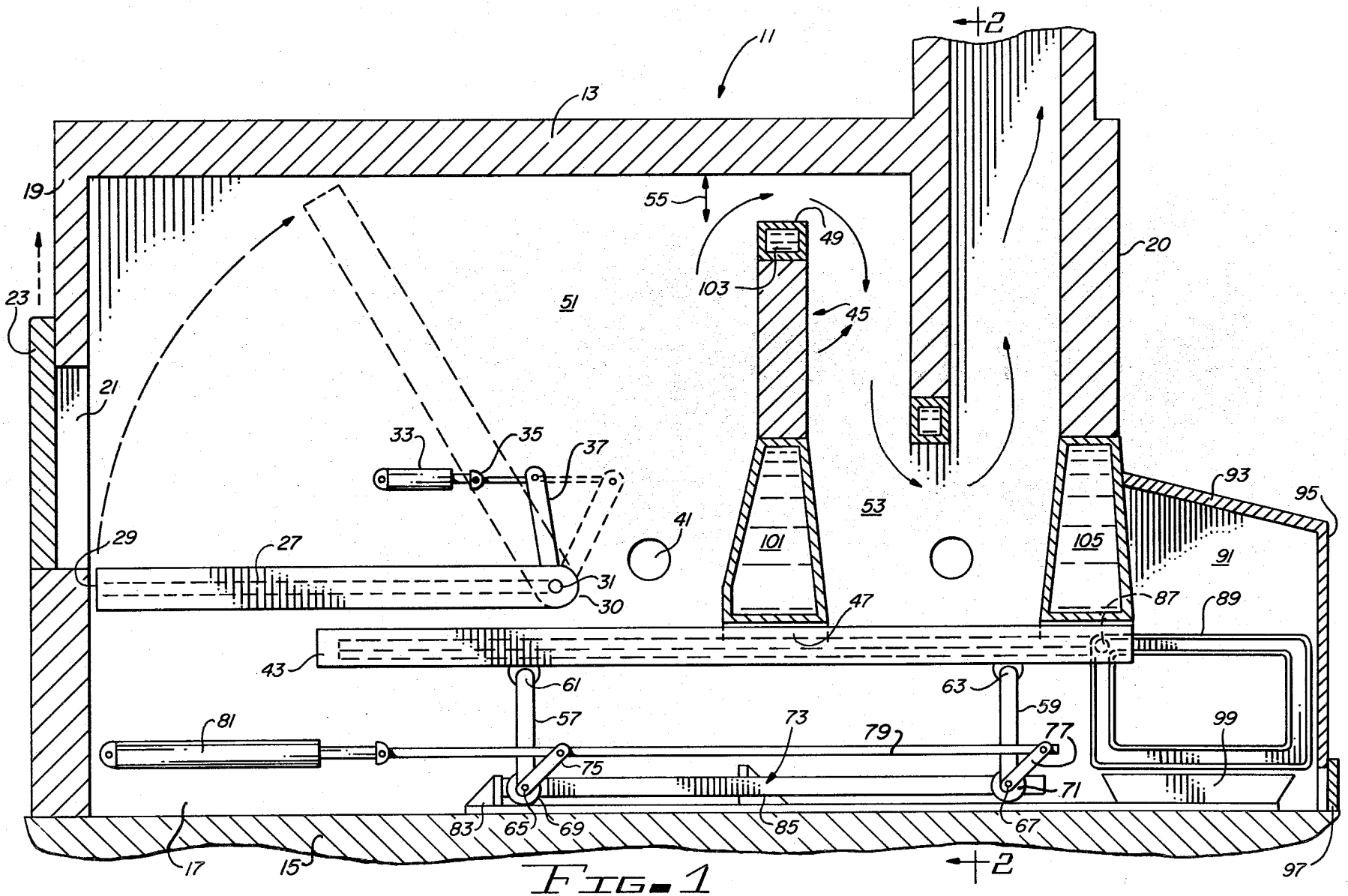
FIG. 1 is a cross sectional side view of the cremator.
Figures 2, 3A, 3B, 3C, 3D:
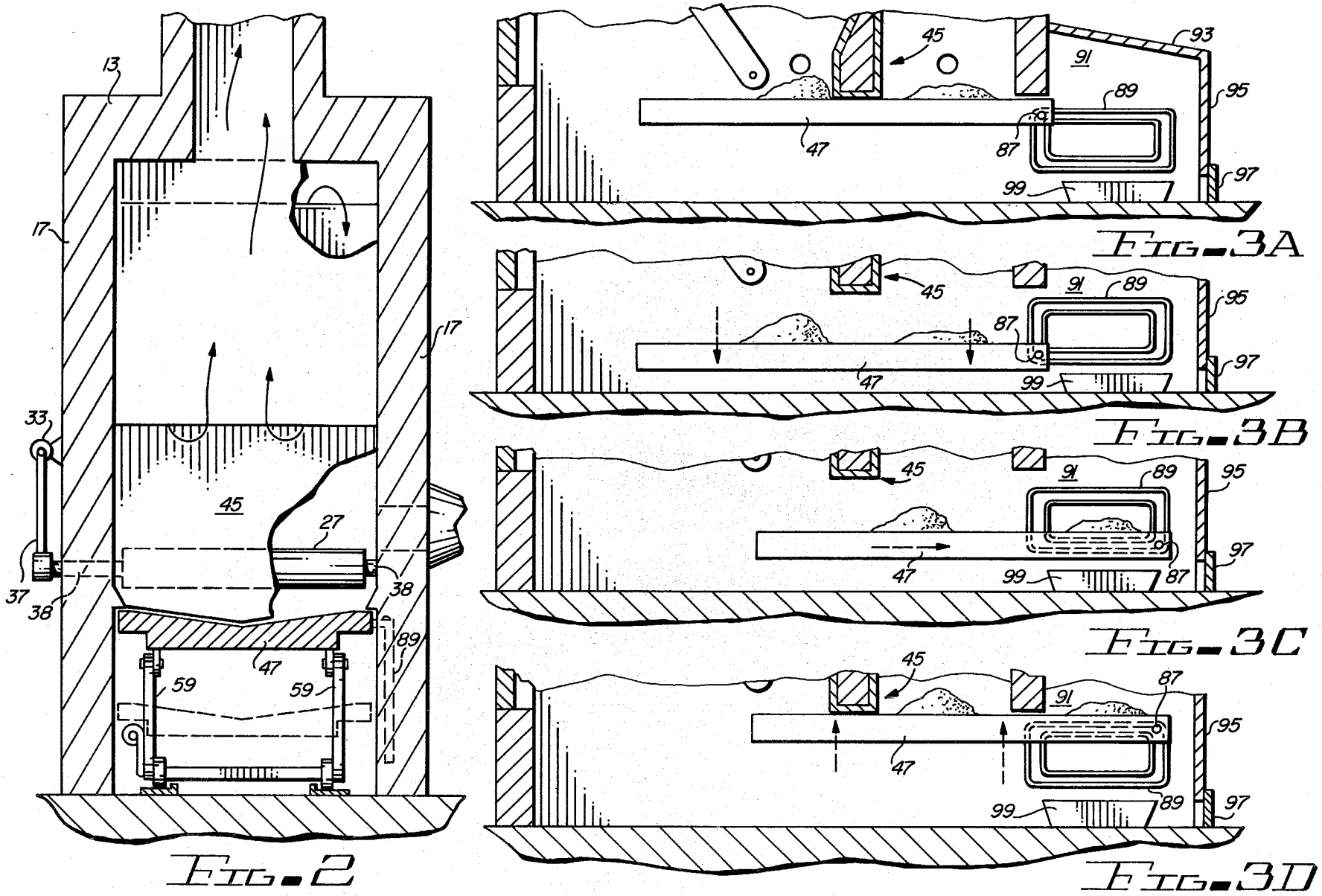
FIG. 2 is a cross section end view of the cremator.
FIGS. 3A–3D are cross sectional side views of the sequence of movement of the moveable hearth.

Illustrated in FIG. 1 and FIG. 2 is a progressive moveable hearth crematory 11 which includes an enclosure of refractory material including a top wall 13; a pair of sidewalls 17; a floor 15; a front wall 19; a rear wall 20. The front wall 19 includes a loading opening 21 and a guillotine door 23 which can alternately open and close the loading opening 21. A pivotable hearth 27 is disposed inside the enclosure having a distal end 29 immediately adjacent to the loading opening 21 and a proximate end 30 disposed in the interior of the enclosure. A shaft 31 is attached to the proximate end 30 of the pivotable hearth 27. The shaft 31 extends through at least one of the sidewalls 17 to a point in the exterior of the enclosure. The pivotable hearth may be provided with internal conduits (not shown) through which cooling liquid may flow. A hydraulic cylinder 33 is attached to the exterior portion of one of the sidewalls 17 and disposed with a ram end 35 pivotally coupled to a pivot arm 37 which is in turn fixed to the shaft 31. A secondary moveable hearth 43 is disposed inside the enclosure having a portion adjacent to and below the proximate end 30 of the pivotable hearth 27. The secondary moveable hearth may be provided with internal conduits through which cooling liquids may flow. An interior wall is disposed between the side walls 17 having a bottom interior wall surface 47 in contact with the secondary moveable hearth 43. The top portion 49 of the interior wall 45 is disposed a predetermined distance from the top wall 13 of the progressive moveable hearth cremator 11. The interior wall 45 thus divides the enclosure into a primary chamber 51 and a secondary chamber 53 which are in communication with one another due to a gap 55 provided between the top of the interior wall 49 and the top wall 13.

A first pair of struts 57 and a second pair of struts 59 are pivotally attached to the secondary moveable hearth 43 at pivot points 61 and 63 respectively. The bottom portions of the first pair of struts 57 are pivotally attached to a shaft 65 and the bottom portion of the second pair of struts 59 are pivotally attached to a shaft 67. Roller 69 and 71 are coupled to shaft 65 and 67 respectively. The space in between shafts 69 and 67 is maintained by means of a retaining member 73 to which the shafts 65 and 67 are attached. A first lever arm 75 is rigidly attached to one of the first pair of struts 57, and a second lever arm 77 is rigidly attached to one of the second pair of struts 59. The ends of the first lever arm 75 and the second lever arm 77 are linked to a rod 79 which is in turn connected to a hydraulic cylinder 81. Stops 83 and 85 are provided on the floor surface to limit the travel of the roller 69 and 71. A roller 87 is provided at the side of secondary moveable hearth 43 where it engages a rectangular channel 89 provided at one of the sidewalls 15. A rectangular channel 89 acts as a cam to direct and control the movement of secondary moveable hearth 43.

A cooling chamber 91 is formed by an addition to the rear wall 20 comprising a sloping wall 93 and a vertical wall 95 having a remains removal door 97. A remains pan 99 is provided in the floor of the cooling chamber 91.

Liquid cooling of the walls may be effectuated by providing a passage 101 and interior wall 45. Passage 101 is filled with a liquid which can be used to cool down the bottom portion of the interior wall 45. This cooling is desired to prevent over expansion of the interior wall 45 due to the heat, particularly at the bottom interior wall surface 47 since the spacing between the surface 47 and the secondary moveable hearth 43 must be maintained to a minimum during operating conditions. Another passage 103 may also be provided in the interior wall 45 near the top 49. Liquid for cooling flows through passage 103 which reduces the high wear point of the top 49 of the interior wall 45 near the top 49. Liquid for cooling flows through passage 103 which reduces the high wear point of the top 49 of the interior wall 45. Similarly, a cooling passage 105 may be provided at the bottom portion of the rear wall 20 so that the area where the bottom wall 20 contacts with the secondary moveable hearth 43 can be cooled, thereby maintaining the necessary maximum spacing.

In operation a body and container are loaded through the loading opening 21 and the guillotine door 23 is closed. At that point pivotable hearth 27 is pivoted upwards to the position indicated by the dashed lines to facilitate gravity feed as the body and container are consumed. Cremation takes place until approximately 80% (by volume) of the container has been consumed in the primary chamber 51. Thus, the partially cremated remains are deposited between the end portion 30 of the pivotable hearth 27 and the interior wall 45. At that point hydraulic cylinder 81 is actuated, thereby causing the secondary moveable hearth 43 to initially drop and then be pushed sideways then upwards again (see FIGS. 3A–3D). Because of the new position of the secondary moveable hearth 47 the partially cremated remains of the first body to be loaded are then found in the secondary chamber 53. The hydraulic cylinder 81 then pulls the secondary moveable hearth 43 back to the initial position and the partially cremated remains are prevented from moving by the interior wall 45 and particularly by the close spacing of between the bottom surface 47 and the moveable hearth 43. At that point a second body may be loaded on the pivotable hearth 27 and the cremation of that second body can begin. The first body is totally consumed in the secondary chamber 53. The secondary moveable hearth 43 is then moved once again through a new cycle and the fully cremated remains of the first body are then scraped by the bottom portion of the end wall 20 and dropped into the remains pan 99. At that point, the remains pan 99 can be removed through the removal door 97 for further processing.

The invention accordingly comprises the several steps and the relation of one or more of such steps with respect to each of the others and the apparatus embodying the features of parts which are adapted to effect such steps, all as exemplified in the recited detailed disclosure, and the scope of the invention which will be recited in the claims.

I claim:

1. A progressive moveable hearth cremator comprising:

an enclosure of refractory material including a top wall, a pair of side walls, a front wall, a rear wall and a floor;

a pivotable hearth coupled to said side walls at a pivot point;

means for rotating said pivotable hearth;

a secondary moveable hearth disposed partially below said pivotable hearth;

means for moving said secondary hearth from an initial position, of alternately downwards, sideways, upwards and back sideways to said initial position;

an interior wall disposed between said sidewalls and immediately adjacent to and in contact with the top of said secondary moveable hearth when said secondary moveable hearth is in its initial position, whereby said interior wall separates said enclosure into a primary and secondary chamber; and at least one fuel burner disposed inside said enclosure.

2. The cremator of claim 1 wherein said means for rotating said pivotable hearth comprises:

a shaft extending through one end of said pivotable hearth and through said sidewalls;

a pivot arm attached to said shaft; and a hydraulic cylinder pivotally attached to one end of said pivot arm.

3. The cremator of claim 1 wherein said means for moving said secondary hearth comprises:

a first strut pivotally mounted to one end of said secondary hearth;

a second strut pivotally mounted to said secondary hearth;

a first roller mounted on said first strut;

a second roller mounted on said second strut;

a first pivot arm fixed to said first strut;

a second pivot arm fixed to said second strut;

a second hydraulic cylinder pivotally coupled to said first and second pivot arms;

a cam roller mounted at the distal end of said secondary hearth; and adapted to engage said roller, whereby the action of the second hydraulic cylinder on the pivot arms causes the cam roller and the secondary hearth to follow a rectangular course constrained by the tract therefore moving the secondary hearth downwards, sideways, upwards and back sideways to the initial position.

4. The cremator of claim 1 wherein said rear wall includes a bottom surface in contact with a portion of the top of said secondary moveable hearth; and further comprising a cooling chamber disposed adjacent to said rear wall.

5. The cremator of claim 1 wherein said interior wall is provided with a passage adjacent to the bottom surface of the interior wall, said passage extending through the interior wall; and further comprising means for providing cooling fluid through said passage.

6. The cremator of claim 1 wherein said rear wall is provided with a passage adjacent to the bottom surface of the rear wall, said passage extending through the rear wall; and further comprising means for providing cooling liquid through passage.

7. The cremator of claim 1 wherein said interior wall is provided with a bottom surface conforming to the shape of the surface of the secondary moveable hearth; and wherein said rear wall is provided with a bottom surface conforming to the surface of said secondary moveable hearth.

8. The cremator of claim 1 where said at least one fuel burner comprises:

a fuel burner disposed in said primary chamber; and a secondary fuel burner disposed in said secondary chamber.

9. The cremator of claim 1 further comprising a cooling chamber extending outwardly from the exterior portion of the rear wall and downwardly to the floor, said cooling chamber extending outwardly a length sufficient to accommodate the distal end of the secondary moveable hearth when said secondary moveable hearth is moved sideways.

10. The cremator of claim 1 wherein said pivotable hearth is provided with a passage therethrough and further comprising means for providing cooling liquid through said passage.

11. A cremator comprising:

an enclosure of refractory material including a front wall with an opening therein, two side walls and a rear wall;

an interior wall disposed inside said enclosure and dividing the interior portion of said enclosure into a primary and secondary chamber;

a pivotable hearth disposing said primary chamber;

a secondary moveable hearth disposed with a portion in said primary chamber and a portion in said secondary chamber said hearth being in close contact with the bottom surface of said interior wall;

means for pivoting said pivotable hearth; and means for alternatively displacing said moveable hearth from an initial position sequentially downward, sideways upwards, and back sideways to the initial position.

* * * * *